United States Patent [19]

Nagel

[11] 4,115,843

[45] Sep. 19, 1978

[54] WARNING LAMP

[75] Inventor: Robert I. Nagel, Mesa, Ariz.

[73] Assignee: Dominion Auto Accessories Limited, Toronto, Canada

[21] Appl. No.: 793,725

[22] Filed: May 4, 1977

[51] Int. Cl.[2] ..... F21V 5/02

[52] U.S. Cl. ..... 362/291; 362/292; 362/311; 362/337

[58] Field of Search ..... 362/280, 282, 291, 300, 362/307, 311, 322, 3, 8, 335–338, 292

[56] References Cited

U.S. PATENT DOCUMENTS

| | | | |
|---|---|---|---|
| 2,918,668 | 12/1959 | Stube | 362/337 X |
| 3,009,054 | 11/1961 | Thomas | 362/337 X |
| 3,392,277 | 7/1968 | Dawson | 362/338 X |
| 3,523,290 | 8/1970 | Elledge, Jr. | 362/338 X |
| 3,679,889 | 7/1972 | Franck | 362/338 X |

*Primary Examiner*—Peter A. Nelson

*Attorney, Agent, or Firm*—Barnes, Kisselle, Raisch & Choate

[57] ABSTRACT

A warning lamp comprising a housing having an annular wall, a bulb having a filament within the confines of the annular wall and a lens closing the end of the annular wall. The lens has a front wall and a peripheral wall surrounding the front wall and telescoped over the annular wall of the housing. A prism is provided on the lens along at least opposed side portions of the peripheral wall of the lens and is constructed and arranged to redirect light from the filament of the bulb in a direction generally at 90° to the axis of the lens.

16 Claims, 5 Drawing Figures

WARNING LAMP

This invention relates to warning lamps.

BACKGROUND AND SUMMARY OF THE INVENTION

It is common and required by regulation or law that industrial and agricultural vehicles used on highways have signal lamps. Typical constructions of such signal lamps are shown in U.S. Pat. Nos. 3,564,483, 3,666,940, Des. 216,915 and Des. 216,914 and comprise a housing having an annular wall and a lens with a front wall and a peripheral wall telescoped over the annular wall.

Established photometric standards such as United States S.A.E. J 96 and J 974 require that the lamp emit minimum candlepower in a direction at 90° to the axis of the lens. More specifically, these standards require a projection of four candlepower at 90°. This standard is difficult to meet and comply with.

An important aspect of the present invention is to provide a warning lamp which meets the photometric standards and provides required light in a direction at 90° to the axis of the lamp lens.

In accordance with the invention, a prism is provided along at least opposed side portions of the peripheral wall of the lens which is constructed and arranged to redirect light from the filament of the bulb in a direction generally at 90° to the axis of the lens.

DESCRIPTION

Figure 1:
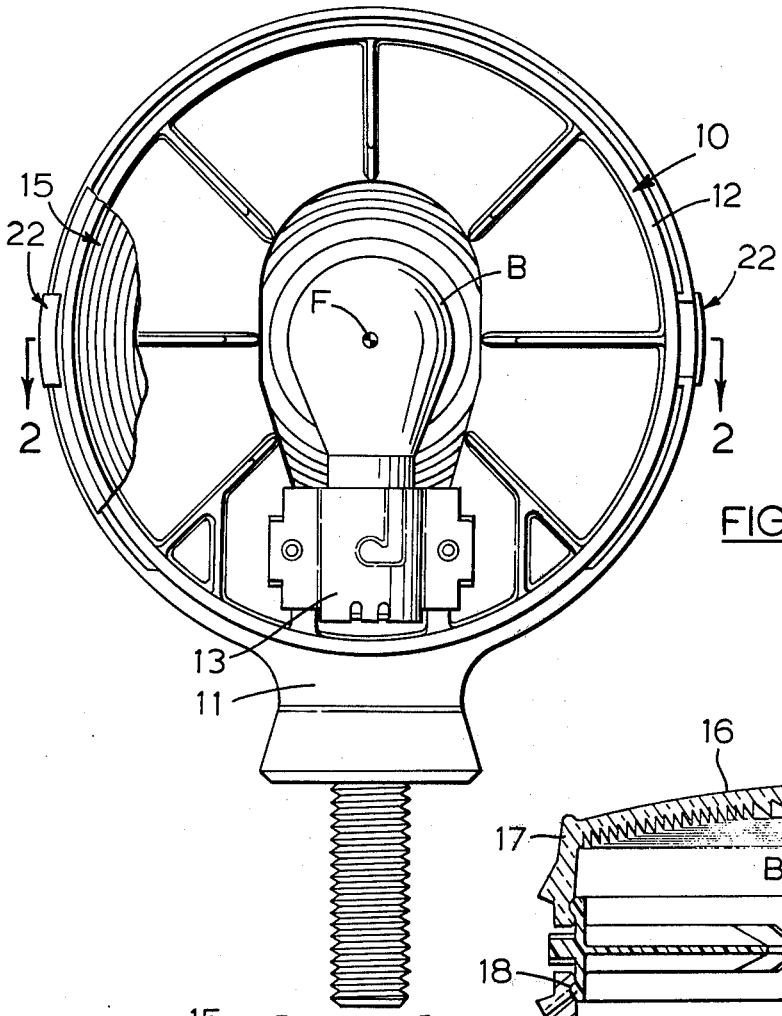
FIG. 1 is a front elevational view of a lamp embodying the invention with a lens removed and part housing cut away.
Figure 2:
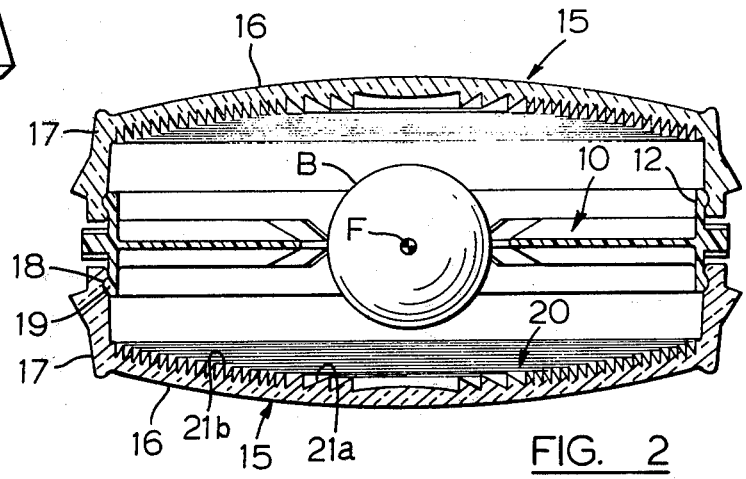
FIG. 2 is a sectional view taken along the line 2—2 in FIG. 1.

Referring to FIGS. 1 and 2, the warning lamp embodying the invention comprises a housing 10 that includes a base 11 forming a means for support on a vehicle. The housing 10 further includes an annular wall 12. A bulb B is supported by a socket 13 within the housing so that its filament F lies in a plane that bisects the annular wall. The support of the socket 13 and associated wiring is more fully disclosed in the aforementioned United States patents which may be referred to for such details of construction.

The lamp includes two lenses 15, each of which has a front wall 16 and a peripheral wall 17 telescoped over the wall 12 of the housing. Interengaging grooves and ribs 18, 19 support the lenses 15 on the housing 10. The inner surface 20 of the front wall 16 conventionally has dioptrics 21*a* and catadioptrics 21*b* thereon to redirect the light from the filament F in a general direction of the axis of the lens 15.

In accordance with the invention, prisms 22 are provided at diametrically opposed points in a horizontal plane containing the axis of the lens, that is, at the sides of the peripheral wall 17. Each prism 22 includes an inclined surface 23 which is at an acute angle to the axis of the lens 15 and at an acute angle to the inner surface of the peripheral wall 17. The prism 22 further includes a lower surface 24 of lesser inclination.

Figure 3:
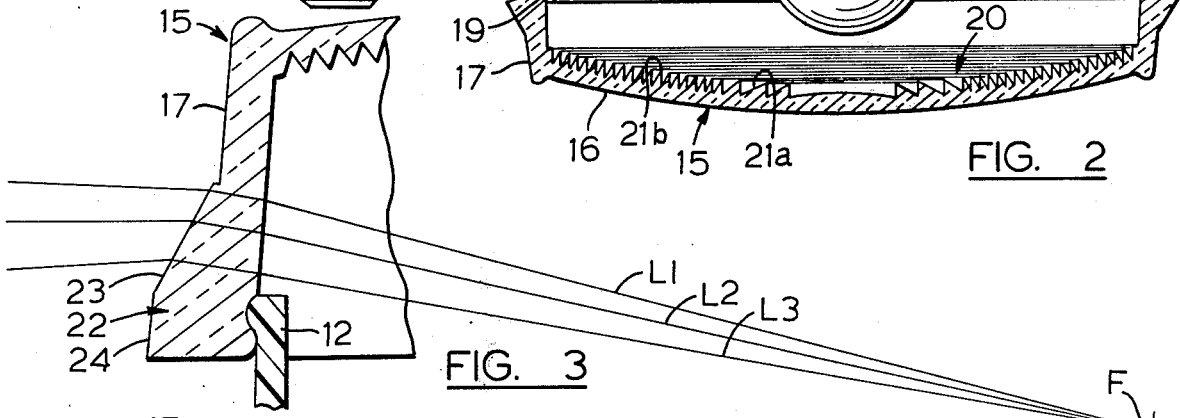
FIG. 3 is a fragmentary sectional view of a portion of a lens shown in FIG. 2 and showing the path of light rays in a horizontal plane.

The manner in which the prisms 22 function to redirect light from the filament F in a horizontal plane in a direction at 90° to the axis of the lens is shown by reference to FIG. 3 wherein the light rays L1, L2, L3 are shown as intersecting the inner surface of the wall 17 and being refracted thereby to the inclined surface 23 of the prism 22 where they are again refracted in a direction more nearly 90° to the axis of the lens.

Figure 4:
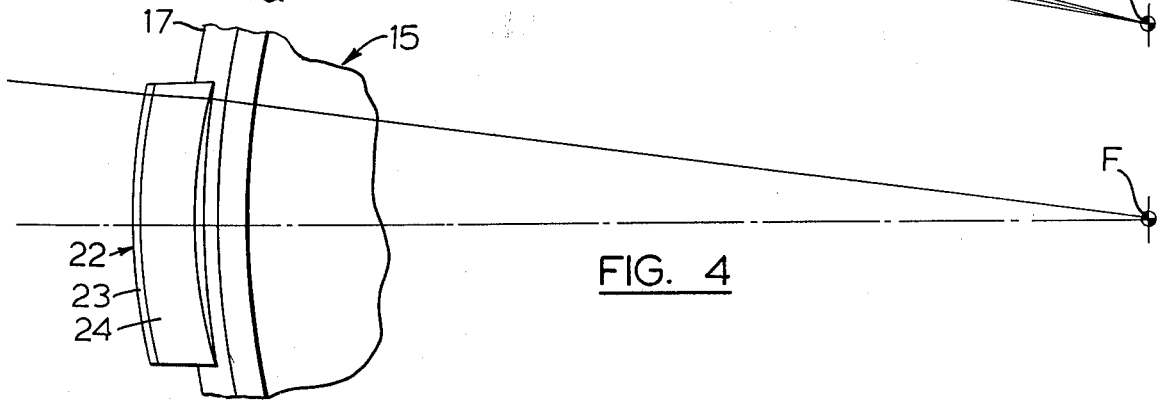
FIG. 4 is a fragmentary front view of the portion of the lens shown in FIG. 3 and showing the path of light rays in a vertical plane.

As further shown in FIG. 4, each surface 23 of lens 22 has a radius of curvature in a plane at a right angle to the axis of the lens which is smaller than the radius of curvature of the inner surface of the wall 17 of the lens so that a positive lens is produced so that light rays, such as light ray L4, are redirected to further concentrate the light in a direction vertically.

Figure 5:
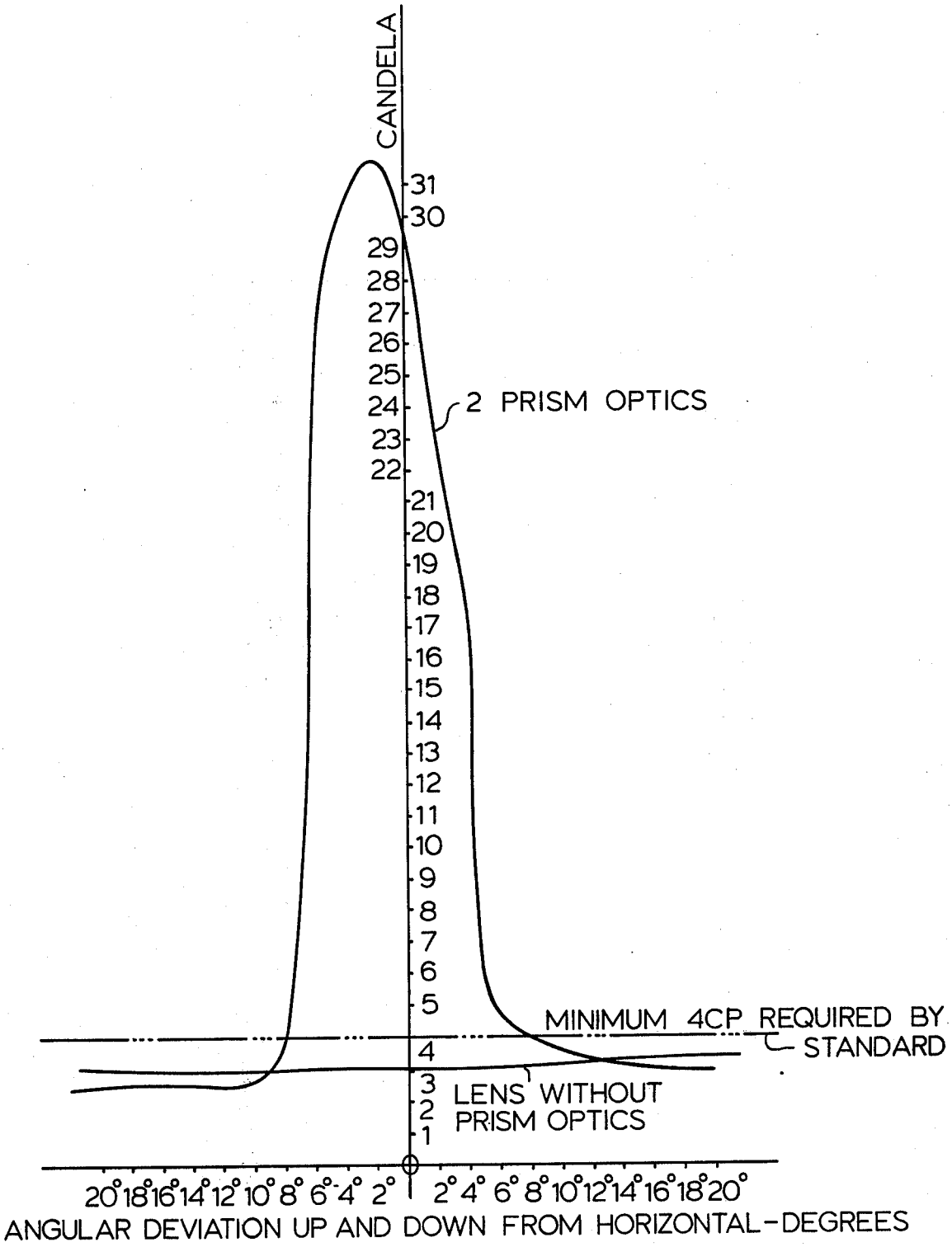
FIG. 5 is a curve of candlepower readings versus angle to the horizontal axis of the lens.

FIG. 5 is a curve of candlepower readings taken in a direction at 90° to the axis of the lens and shows the manner in which the prism functions to provide the desired candlepower reading. As shown, in the absence of the prism, the filament does not produce any reading above the desired minimum candlepower. With the lens with prisms in position, the candlepower reading is greatly exceeded.

I claim:

1. In a signal lamp, the combination comprising
- a housing having an annular wall,
- a bulb having a filament within the confines of the annular wall,
- a lens closing the end of the annular wall,
- said lens having a front wall and a peripheral wall surrounding the front wall and telescoped over the annular wall of the housing,
- and a prism formed on said peripheral wall of said lens along at least opposed side portions of said peripheral wall of said lens and constructed and arranged to redirect light from the filament of said bulb in a direction generally at 90° to the axis of the lens.

2. The combination set forth in claim 1 wherein said prism includes an inclined surface which is at an axis to the inner surface of the peripheral wall and forms an acute angle with the axis of the lens to redirect the light from the filament by refraction at the inner surface of the wall of the lens and refraction at said surface of said prism.

3. The combination set forth in claim 2 wherein said inclined surface of said prism has a curvature in a plane at a right angle to the axis of the lens and has a radius less than the radius of the inner surface of the wall of the lens.

4. The combination set forth in claim 1 including indicia on said lens indicating the top of said lens such that said lens is oriented with said prisms at the sides of said lens.

5. The combination set forth in claim 1 wherein the inner surface of the front wall of the lens is formed with dioptrics or catadioptrics.

6. The combination set forth in claim 1 wherein said housing has a second open end,
- a second lens closing the end of the annular wall,
- said second lens having a front wall and a peripheral wall surrounding the front wall and telescoped over the annular wall of the housing, and a prism formed on said peripheral wall of said second lens along at least opposed side portions of said peripheral wall of said second lens and constructed and arranged to redirect light from the filament of said bulb in a direction generally at 90° to the axis of the second lens.

7. For use in a signal lamp, a lens adapted to be mounted on a housing to close the end of the annular wall of the housing, said lens having a front wall and a peripheral wall surrounding the front wall and adapted to be telescoped over the annular wall of a housing, and a prism formed on said peripheral wall of said lens along at least opposed side portions of said peripheral wall of said lens and constructed and arranged to redirect light from the filament of said bulb in a direction generally at 90° to the axis of the lens.

8. The combination set forth in claim 7 wherein said prism includes an inclined surface which is at an axis to the inner surface of the peripheral wall and forms an acute angle with the axis of the lens to redirect the light from the filament by refraction at the inner surface of the wall of the lens and refraction at said surface of said prism.

9. The combination set forth in claim 8 wherein said inclined surface of said prism has a curvature in a plane at a right angle to the axis of the lens and has a radius less than the radius of the inner surface of the wall of the lens.

10. The combination set forth in claim 7 including indicia on said lens indicating the top of said lens such that said lens is oriented with said prisms at the sides of said lens.

11. The combination set forth in claim 7 wherein the inner surface of the front wall of the lens is formed with dioptrics or catadioptrics.

12. In a signal lamp, the combination comprising a housing having an annular wall, a bulb having a filament within the confines of the annular wall, a lens closing the end of the annular wall, said lens having a front wall and a peripheral wall surrounding the front wall, inclined to the axis of said lens and telescoped over the annular wall of the housing, and a prism formed on said peripheral wall of said lens along at least opposed side portions of said peripheral wall of said lens and constructed and arranged to redirect light from the filament of said bulb in a direction generally at 90° to the axis of the lens.

13. The combination set forth in claim 12 wherein said prism includes an inclined surface which is at an axis to the inner surface of the peripheral wall and forms an acute angle with the axis of the lens to redirect the light from the filament by refraction at the inner surface of the wall of the lens and refraction at said surface of said prism.

14. The combination set forth in claim 13 wherein said inclined surface of said prism has a curvature in a plane at a right angle to the axis of the lens and has a radius less than the radius of the inner surface of the wall of the lens.

15. The combination set forth in claim 12 including indicia on said lens indicating the top of said lens such that said lens is oriented with said prisms at the sides of said lens.

16. The combination set forth in claim 12 wherein the inner surface of the front wall of the lens is formed with dioptrics or catadioptrics.

* * * * *